US012029293B2

(12) United States Patent
Bond

(10) Patent No.: US 12,029,293 B2
(45) Date of Patent: Jul. 9, 2024

(54) FOLDABLE JEWELRY BOX

(71) Applicant: Beyond CenterLine Solutions LLC, Colorado Springs, CO (US)

(72) Inventor: Richard Michael Bond, Colorado Springs, CO (US)

(73) Assignee: Beyond CenterLine Solutions LLC, Colorado Springs, CO (US)

( * ) Notice: Subject to any disclaimer, the term of this patent is extended or adjusted under 35 U.S.C. 154(b) by 0 days.

(21) Appl. No.: 17/929,126

(22) Filed: Sep. 1, 2022

(65) Prior Publication Data

US 2024/0074557 A1 Mar. 7, 2024

(51) Int. Cl.
*A45C 11/16* (2006.01)
*A47F 7/03* (2006.01)

(52) U.S. Cl.
CPC ..... *A45C 11/16* (2013.01); *A47F 7/03* (2013.01)

(58) Field of Classification Search
CPC ..... A45C 11/16; A47F 7/03
USPC ..... 206/6.1, 736, 211; 211/85.2, 13, 96
See application file for complete search history.

(56) References Cited

U.S. PATENT DOCUMENTS 2,485,201 A * 10/1949 Jewett ..... A47G 25/746 116/63 P
2,905,328 A * 9/1959 Munao ..... A47F 7/02 D6/321
3,718,260 A * 2/1973 Sharp ..... A47F 7/02 211/85.2
4,141,453 A * 2/1979 Hanan ..... A47F 5/02 211/85.2
4,671,415 A * 6/1987 Manhart ..... A47F 7/02 211/85.2
5,054,624 A * 10/1991 Camp ..... A47F 5/02 211/85.2
5,067,617 A 11/1991 Caldwell et al.
5,172,815 A * 12/1992 Schock ..... A47F 1/082 211/85.2
5,449,073 A * 9/1995 DeBeverly ..... A47F 7/00 211/85.2
5,692,601 A * 12/1997 Moss ..... A47F 7/022 206/457
6,206,210 B1 * 3/2001 Reed ..... A47F 5/0087 211/96
10,098,480 B1 * 10/2018 DeLuca ..... A45C 7/00
(Continued)

*Primary Examiner* — Ernesto A Grano
*Assistant Examiner* — Symren K Sanghera
(74) *Attorney, Agent, or Firm* — Briggs IP; Jeremy A. Briggs

(57) ABSTRACT

A jewelry box is disclosed. The jewelry box may include a base and a plurality of vertical elongated fingers pivotably attached to the base. The plurality of vertical elongated fingers may be placed adjacent to each other and at a first predetermined distance from each other. Further, the plurality of vertical elongated fingers may be configured to pivot around vertical elongated fingers distal ends to move the plurality of vertical elongated fingers between an open position and a closed position. The plurality of vertical elongated fingers is in the open position when the plurality of vertical elongated fingers is perpendicular to a base plane and in the closed position when the plurality of vertical elongated fingers is parallel to the base plane. The jewelry box may further include a plurality of horizontal tension members, which may form an inward binding force and may horizontally couple vertical elongated fingers.

20 Claims, 5 Drawing Sheets

(56) References Cited

U.S. PATENT DOCUMENTS

| | | | | |
|---|---|---|---|---|
| 2005/0194334 | A1* | 9/2005 | Johnson | A45D 8/36 211/85.2 |
| 2009/0139878 | A1* | 6/2009 | Wejrowski | A47B 67/005 206/6.1 |
| 2010/0000884 | A1* | 1/2010 | Harris-Bowman | A47F 7/03 206/6.1 |
| 2015/0122820 | A1* | 5/2015 | Whitley | A45C 13/02 220/528 |

* cited by examiner

FOLDABLE JEWELRY BOX

TECHNICAL FIELD

The present disclosure relates to a jewelry box, and more specifically to a foldable jewelry box configured to hold earrings between elongated fingers that are attached to each other via tension springs.

BACKGROUND

Jewelry items, such as necklaces, bracelets, rings, brooches and earrings, are typically small and expensive. Jewelry owners prefer to store the jewelry items at places that are easily accessible and safe. Further, the jewelry owners usually prefer to display their expensive jewelry possession to others. For example, jewelry shop owners or people at home use jewelry boxes or display racks to organize, store and display jewelry items.

A conventional jewelry box stores different types of jewelry items. For example, a single jewelry box may include compartments to store necklaces, rings, earrings, bracelets and similar other jewelry items. Since the jewelry items are small, they may tangle with each other if multiple items are stored in a single jewelry box. Untangling the jewelry items may be time consuming and may even damage the jewelry.

Further, smaller jewelry items like earrings may get misplaced in a jewelry box that stores multiple items. In addition, the conventional jewelry box may not be convenient to organize and store earrings, as the conventional jewelry box may not have dedicated storage space to store and/or to display the earrings.

Typically, earring display racks may enable earring owners to organize and display the earrings, however conventional earring display racks are large-sized and bulky and may not be convenient to carry.

Thus, there is a need for a portable jewelry box that enables jewelry item owners, especially owners of smaller jewelry items like earrings, to conveniently organize, store and display the jewelry items.

It is with respect to these and other considerations that the disclosure made herein is presented.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
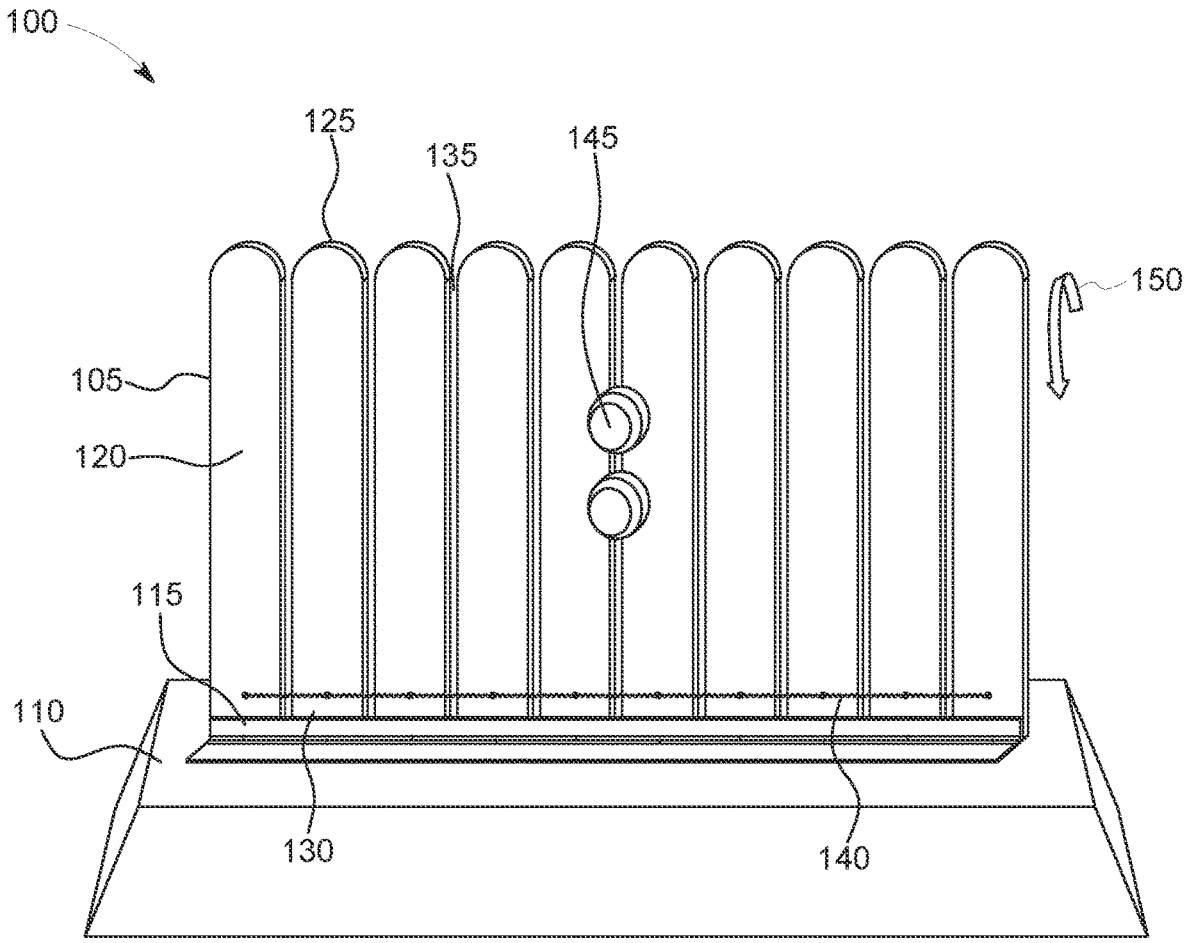
FIG. 1 depicts an example jewelry box in accordance with the present disclosure.

The present disclosure is directed towards a jewelry box that may be used to organize, store and display jewelry items, specifically earrings. The jewelry box may include a plurality of elongated vertical fingers that may be pivotably attached to a jewelry box base. Each elongated vertical finger may be attached at a predetermined distance from adjacent elongated vertical finger, such that openings may be formed between adjacent pairs of elongated vertical fingers. A jewelry box user may slide or insert earrings, for example, stud earrings, in the openings to organize the stud earrings. The jewelry box may further include a plurality of horizontal tension members that may attach adjacent elongated vertical fingers. Specifically, each horizontal tension member may include a spring that may horizontal couple adjacent elongated vertical fingers, such that an inward binding force may be formed between the adjacent elongated vertical fingers. The inward binding force may enable the adjacent elongated vertical fingers to securely hold the stud earrings in the opening formed between the adjacent elongated vertical fingers.

In some aspects, the jewelry box user may move/fold the plurality of elongated vertical fingers from an open position to a closed position, when the jewelry box is not in use. The jewelry box user may move/fold the plurality of elongated vertical fingers about the jewelry box base by using a pivot means. In one or more aspects, the plurality of elongated vertical fingers is in the open position when the plurality of elongated vertical fingers is aligned vertically perpendicular to a jewelry box base plane. Further, the plurality of elongated vertical fingers is in the closed position when the plurality of elongated vertical fingers is aligned laterally parallel to the jewelry box base plane. In other words, the plurality of elongated vertical fingers is in the closed position when the elongated vertical fingers are folded to lay parallel to the jewelry box base plane.

The jewelry box may further include a plurality of horizontal elongated fingers that may be pivotally attached to the jewelry box base by using a vertical support structure. Like the plurality of elongated vertical fingers, the plurality of horizontal elongated fingers may be placed adjacent to each other on the vertical support structure and may form openings between adjacent horizontal elongated fingers. The openings between adjacent horizontal elongated fingers may enable the jewelry box user to organize hoop earrings in the jewelry box.

In some aspects, a single jewelry box may include the plurality of elongated vertical fingers and the plurality of horizontal elongated fingers. In this manner, the jewelry box user may organize, store and display different types of earrings, e.g., stud earrings and hoop earrings, in the same jewelry box.

The present disclosure discloses a jewelry box that is portable and convenient for a user to carry. For example, the plurality of elongated vertical fingers and/or the plurality of horizontal elongated fingers may be folded to lie in a rest position (e.g., closed position) on the jewelry box base, when the jewelry box is not in use. The jewelry box user may easily carry the jewelry box when the elongated fingers are placed in the rest position. Further, the jewelry box includes dedicated elongated fingers to organize earrings. Therefore, the earrings, which are typically small and expensive, do not tangled with other jewelry items that may be present in the jewelry box and do not get misplaced. Furthermore, the jewelry box, as proposed in the present disclosure, enables the jewelry box user to store and display different types of earrings in the same jewelry box. Therefore, the jewelry box user is not required to use/purchase different jewelry boxes for different types of earrings.

These and other advantages of the present disclosure are provided in detail herein.

Illustrative Embodiments

The disclosure will be described more fully hereinafter with reference to the accompanying drawings, in which example embodiments of the disclosure are shown, and not intended to be limiting.

FIG. 1 depicts an example jewelry box 100 in accordance with the present disclosure. The jewelry box 100 may be configured to organize, store and display jewelry items, such as necklaces, bracelets, rings, brooches, earrings, etc. Specifically, the jewelry box 100 may have a dedicated structure to organize, store and display earrings. Examples of the earrings include, but are not limited to, stud earrings, drop earrings, cluster earrings, dangle earrings, hoop earrings, huggie earrings, chandelier earrings and the like.

In some aspects, the jewelry box 100 may include a plurality of vertical elongated fingers 105 that may be configured to organize, store and display earrings, specifically stud earrings. The plurality of vertical elongated fingers 105 may be pivotally attached to a base 110, via a pivot means 115. The pivot means 115 may include, for example, mechanical pivot means or servomotors.

In some aspects, the plurality of vertical elongated fingers 105 may be made of plastic, metal and/or wood. For example, the plurality of vertical elongated fingers 105 may be made from hardwood such as oak, maple, teak, sapele, iroko or from coniferous wood. Similarly, the base 110 may be made of same material as the plurality of vertical elongated fingers 105 or may be made from a different material. For example, in one or more aspects, the plurality of vertical elongated fingers 105 and the base 110 may be made of oak. In other aspects, the plurality of vertical elongated fingers 105 may be made of plastic and the base 110 may be made of oak (or any other type of wood).

As shown in FIG. 1, the plurality of vertical elongated fingers 105 may have a flattened front surface 120 and a flattened back surface (not shown) opposite to the flattened front surface 120. In some aspects, the flattened front surface 120 and/or the flattened back surface may include magnetic strips or may have magnetic coating. In other aspects, the flattened front surface 120 and/or the flattened back surface may have a metallic or a paint coating to form a glass-smooth finish. In additional aspects, the flattened front surface 120 may include magnetic coating and the flattened back surface may have metallic or paint coating (or vice versa). In a similar manner, the base 110 may include a plurality of magnetic strips or may have magnetic coating.

Further, each vertical elongated finger 105 may be of same length and width. For example, in one or more aspects, each vertical elongated finger 105 may be in a range of five to seven inches tall and may have a width of half an inch. In other aspects, each vertical elongated finger 105 may be less than five inches tall and have a width of an inch.

A person ordinarily skilled in the art may appreciate that vertical elongated finger length and width described above are just examples and are not intended to limit the present disclosure scope.

In further aspects, each vertical elongated finger 105 may include a proximal end 125 and a distal end 130. The proximal end 125 may have a flat or a round shape. For example, as shown in FIG. 1, the proximal end 125 may have a semi-circular shape. The distal end 130 may have a flat shape (not shown) and may be pivotably attached to the base 110.

In some aspects, the plurality of vertical elongated fingers 105 may be placed/attached to the base 110 via the distal ends 130. Further, the plurality of vertical elongated fingers 105 may be placed adjacent to each other. Furthermore, each vertical elongated finger may be placed at a first predetermined distance from adjacent vertical elongated fingers. Specifically, the distal ends 130 may be arranged at the first predetermined distance from each other, such that an opening 135 or an earring holding space may be formed between two adjacent vertical elongated fingers. In other words, there may be an opening between a pair of vertical elongated fingers to organize and store the earring. In some aspects, the first predetermined distance may be, for example, in a range of 0.1 to 0.5 centimeters.

In one or more aspects, a distance between the distal ends 130 of two adjacent vertical elongated fingers may be same as a distance between the corresponding proximal ends 125. For example, as shown in FIG. 1, the plurality of vertical elongated fingers 105 may be parallel to each other. In other words, the opening 135 formed between two adjacent vertical elongated fingers may have same width from the distal ends 130 to the proximal ends 125 of the adjacent vertical elongated fingers.

In other aspects, the distance between the distal ends 130 of two adjacent vertical elongated fingers may be smaller than the distance between the corresponding proximal ends 125. In other words, the adjacent vertical elongated fingers may be slanted "outwards" (not shown in FIG. 1), such that the opening 135 formed between the adjacent vertical elongated fingers is V-shaped. A slant angle of adjacent vertical elongated fingers or an angle of V-shaped opening 135 may be, for example, in the range of one to five degrees.

In some aspects, a horizontal tension member 140 may attach a distal end 130 of a vertical elongated finger 105 to a distal end 130 of an adjacent vertical elongated finger. Specifically, the jewelry box 100 may include a plurality of horizontal tension members 140 that attaches the adjacent vertical elongated fingers together, such that an inward binding force may be formed between the adjacent vertical elongated fingers. For example, the horizontal tension member 140 may be a spring that may be attached in proximity to the distal ends 130 of adjacent vertical elongated fingers and that may bind the adjacent vertical elongated fingers together.

In some aspects, as shown in FIG. 1, the plurality of horizontal tension members 140 may be aligned parallel to a base plane and perpendicular to a vertical elongated finger plane, and the plurality of horizontal tension members 140 may horizontally couple adjacent vertical elongated fingers. In other aspects, the plurality of horizontal tension members 140 may be slanted (not shown in FIG. 1) at a predetermined angle with respect to the base plane. For example, the predetermined angle may be in a range of 1 to 30 degrees. In further aspects, the horizontal tension members 140 may be arranged on the flattened front surface 120 or the flattened back surface.

In operation, a jewelry box user may use the opening 135 to organize (or hold) and display stud earrings 145 (or a stud earring 145). Specifically, the jewelry box user may open a stud earring clasp (which may be present at a stud earring back portion) and insert the stud earring 145 in the opening 135. The jewelry box user may close the stud earring clasp when the stud earring 145 is positioned in the opening 135. Alternatively, the jewelry box user may slide the stud earring 145 (with or without the stud earring clasp attached to the stud earring 145) along the opening 135 and position the stud earring 145 in a proximity to the distal ends 130 or anywhere along an opening length.

When the jewelry box user inserts (or slides) the stud earring 145 in the opening 135, the corresponding adjacent vertical elongated fingers may move away from each other to allow stud earring insertion. The horizontal tension member 140 may form a binding force inwards between the adjacent vertical elongated fingers, which may allow the adjacent vertical elongated fingers to securely hold the stud earring 145. In this manner, the jewelry box user may use the jewelry box 100 to organize, store and display the stud earring 145, by using the plurality of vertical elongated fingers 105.

A person ordinarily skilled in the art may appreciate that a single opening 135 may organize, store and display multiple stud earrings, based on vertical elongated fingers' length. Further, the plurality of vertical elongated fingers 105 may be configured to store stud earrings of different sizes and shapes.

In some aspects, the jewelry box 100 may include additional elements (not shown), for example, mirrors, jewelry box cover, multiple compartments for accessories or other jewelry items, etc. Since the plurality of vertical elongated fingers 105 form a dedicated structure in the jewelry box 100 to store and display stud earrings, the stud earrings do not get tangled with other jewelry items or get misplaced in the jewelry box 100. Further, in a scenario where a stud earring falls from the opening 135, the magnetic strips present on the base 110 may catch the fallen earring (especially earrings with ferrous material) and prevent the earring from being misplaced. In a similar manner, the magnetic coating on the plurality of vertical elongated fingers 105 may prevent the stud earrings from being misplaced.

In further aspects, the jewelry box user may move the plurality of vertical elongated fingers 105 to a "closed" position, when the jewelry box 100 is not in use (with or without the stud earrings stored in the opening 135). For example, the jewelry box user may pivot the plurality of vertical elongated fingers 105 around the distal ends 130 (as shown by an arrow 150), by using the pivot means 115, to move the plurality of vertical elongated fingers 105 from an open position to the closed position. In some aspects, the plurality of vertical elongated fingers 105 may be vertically perpendicular to the base plane when the plurality of vertical elongated fingers 105 is in the open position. Further, the plurality of vertical elongated fingers 105 may be laterally parallel to the base plane when the plurality of vertical elongated fingers 105 is in the closed or "rest" position.

In some aspects, the jewelry box user may manually push the plurality of vertical elongated fingers 105 to move from the open position to the closed position, when the pivot means 115 may be, for example, mechanical rollers or other mechanical pivot means. In other aspects, the plurality of vertical elongated fingers 105 may move from the open position to the closed position automatically, when the jewelry box user closes the jewelry box cover. In this case, the jewelry box 100 may include a proximity or motion sensor/actuator to detect that the jewelry box user is closing the jewelry box cover and the pivot means 115 may include servomotors to move the plurality of vertical elongated fingers 105, in response to the jewelry box cover closing.

In additional aspects, the jewelry box 100 may include a dedicated button or actuator (not shown) to cause vertical elongated fingers' movement. In this case, the dedicated button may be placed anywhere on a jewelry box body (e.g., on the base 110) and the jewelry box user may press the button to move the plurality of vertical elongated fingers 105 from the open to the closed position (or vice-versa).

Figure 4:
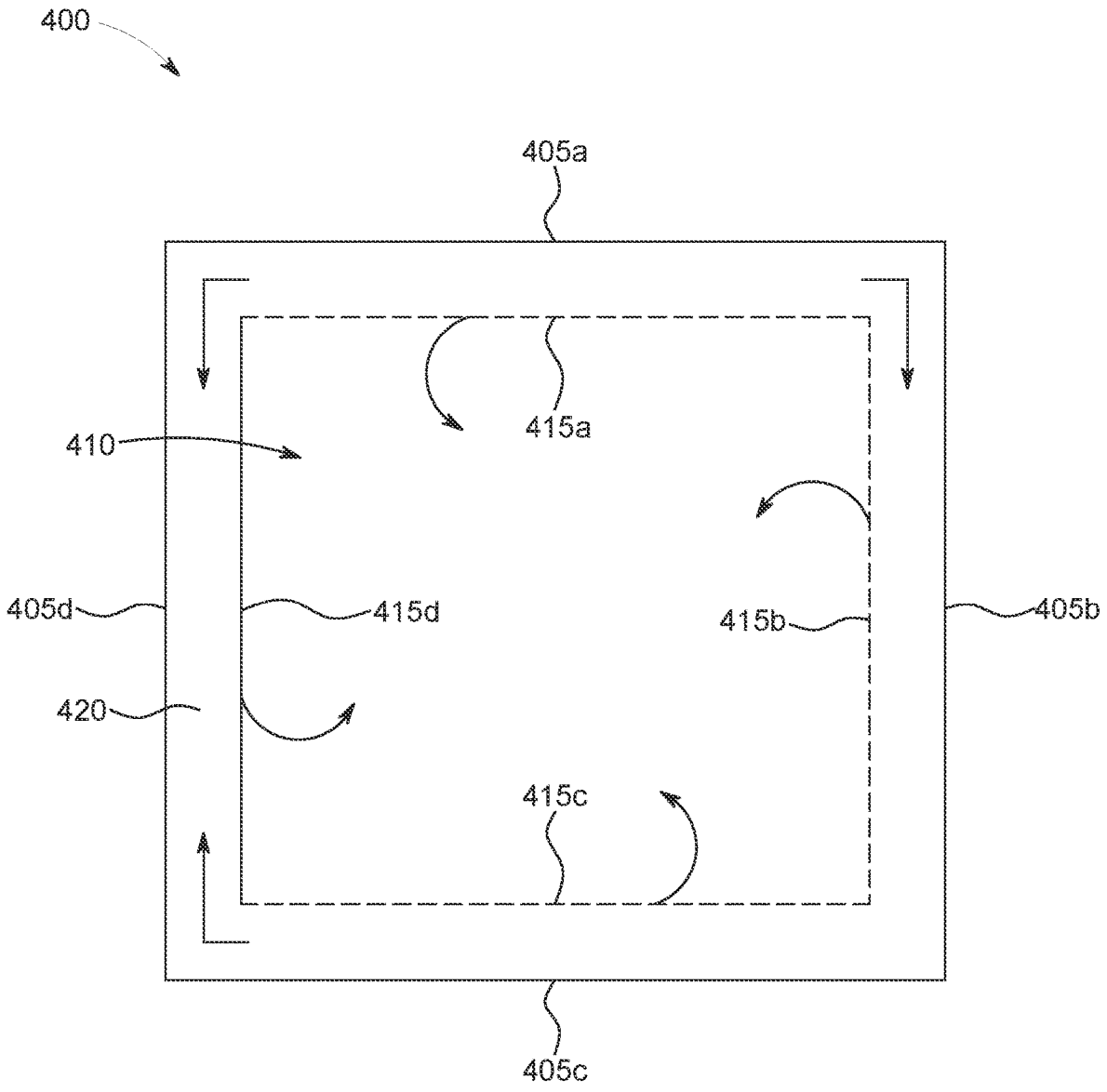
FIG. 4 depicts another example jewelry box in accordance with the present disclosure.
Figure 5:
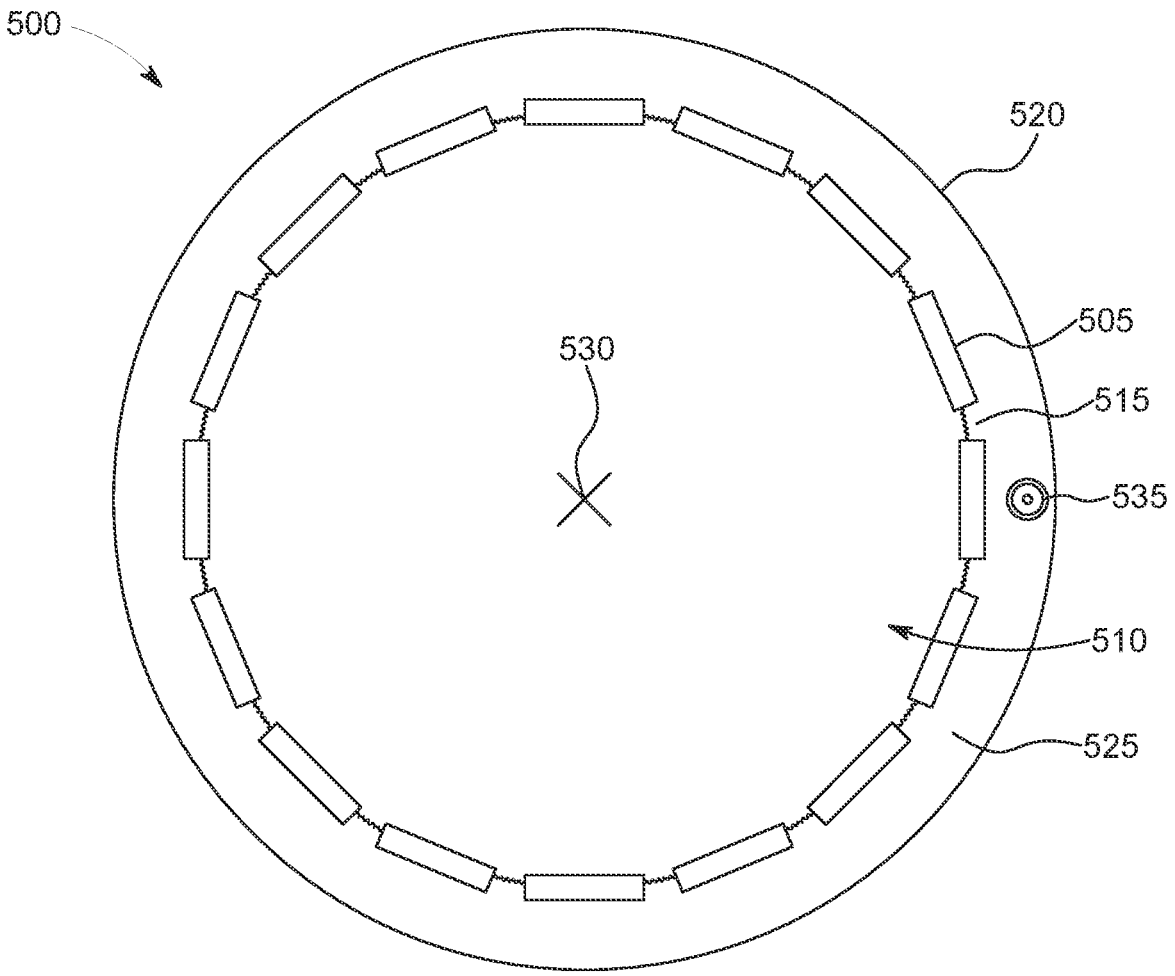
FIG. 5 depicts yet another example jewelry box in accordance with the present disclosure.

Furthermore, in some aspects, the plurality of vertical elongated fingers 105 may be arranged in a linear arrangement (as shown in FIG. 1,) or in a square, rectangular, circular, semi-circular, or an arc-shaped arrangement. Depending on a jewelry box size, the plurality of vertical elongated fingers 105 may be arranged in different arrangements, such that the plurality of vertical elongated fingers 105 may easily move from the open position to the closed position (and vice-versa). Examples of vertical elongated fingers' different arrangements are shown in FIG. 4 and FIG. 5.

Figure 2:
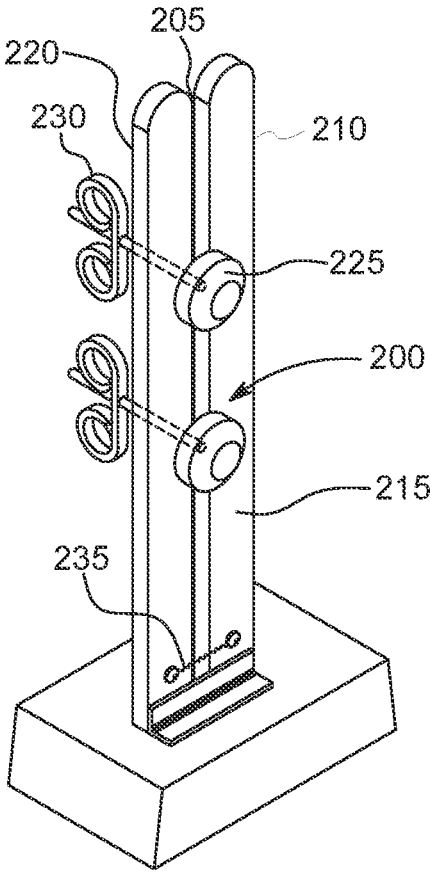
FIG. 2 depicts example stud earrings stored in a portion of the jewelry box in accordance with the present disclosure.

FIG. 2 depicts example stud earrings 200 stored in a portion of the jewelry box 100 in accordance with the present disclosure. Specifically, FIG. 2 depicts an isometric view of the stud earrings 200 inserted in an opening 205 between a pair of vertical elongated fingers 210 (same as the plurality of vertical elongated fingers 105). For the sake of simplicity, FIG. 2 depicts two vertical elongated fingers 210. However, as described in conjunction with FIG. 1, the jewelry box 100 may include a plurality of vertical elongated fingers.

In some aspects, each vertical elongated finger 210 may include a flattened front surface 215 and a flattened back surface 220. As shown in FIG. 1, a stud earring front portion 225 may be in a proximity of or may touch the flattened front surface 215 and a stud earring clasp 230 may be in a proximity of or may touch the flattened back surface 220. As described above, the jewelry box user may slide the stud earring 200 in the opening 205 and may tighten the stud earring clasp 230, which may secure the stud earring 200 between the pair of vertical elongated fingers 210. Alternatively, the jewelry box user may first disengage the stud earring clasp 230 from the stud earring 200 and then insert the stud earring 200 in the opening 205. Thereafter, the jewelry box user may engage and tighten the stud earring clasp 230.

A person ordinarily skilled in the art may appreciate that the jewelry box user may organize, store and display stud earrings of different sizes in the opening 205, by using the arrangement shown in FIG. 2, Further, as described above in conjunction with FIG. 1, the flattened front surface 215 and/or the flattened back surface 220 may include magnetic coating. The magnetic coating allows the stud earring 200 to be securely held between the pair of vertical elongated fingers 210, when either the stud earring front portion 225 or the stud earring clasp 230 includes ferrous material. Furthermore, a horizontal tension member 235 (same as the horizontal tension members 140) may further enable the stud earring 200 to be securely held between the pair of vertical elongated fingers 210. As discussed above, the horizontal tension member 235 may be placed on the flattened front surface 215 and/or the flattened back surface 220. In further aspects, the horizontal tension member 235 may be attached to vertical elongated fingers' edges that are in proximity to the opening 205.

Figure 3:
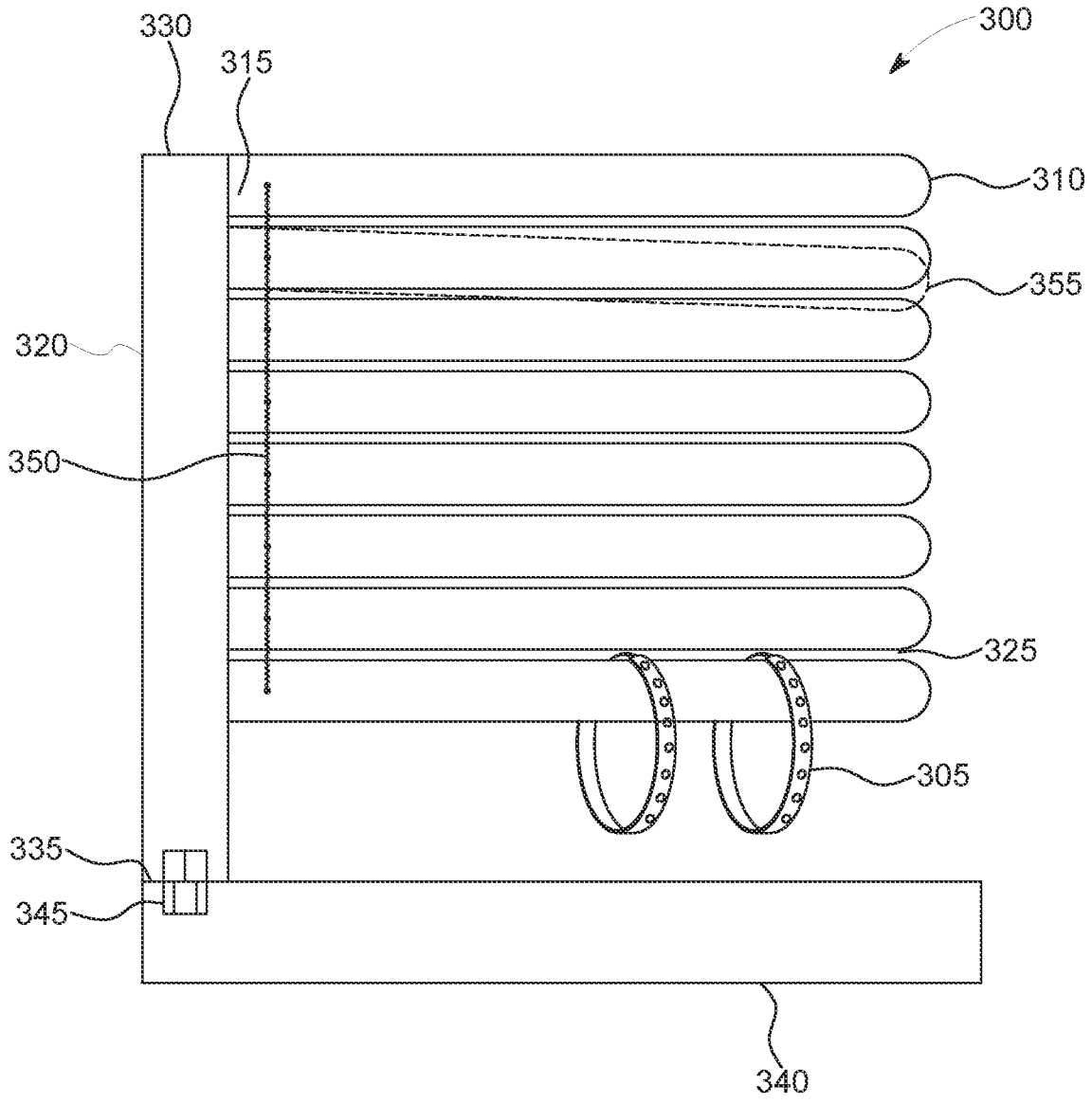
FIG. 3 depicts an example plurality of horizontal elongated fingers in the jewelry box in accordance with the present disclosure.

FIG. 3 depicts an example plurality of horizontal elongated fingers 300 in a jewelry box (e.g., the jewelry box 100) in accordance with the present disclosure. In some aspects, the plurality of horizontal elongated fingers 300 may be same as or similar to the plurality of vertical elongated fingers 105, however the plurality of horizontal elongated fingers 300 may be laterally aligned parallel to the base plane. The plurality of horizontal elongated fingers 300 may be made of same material as the plurality of vertical elongated fingers 105 (and the base 110). The plurality of horizontal elongated fingers 300 may be configured to organize, store and display a hoop earring 305 in a jewelry box (e.g., the jewelry box 100).

As shown in FIG. 3, the plurality of horizontal elongated fingers 300 may include proximal ends 310 and distal ends 315. The plurality of horizontal elongated fingers 300 may be attached to a vertical support structure 320 via the distal ends 315. In some aspects, the plurality of horizontal elongated fingers 300 may be placed adjacent to each other along a vertical support structure length. Each horizontal elongated finger may be placed at a second predetermined distance from adjacent horizontal elongated fingers. In one or more aspects, the second predetermined distance may be similar to or slightly greater than the first predetermined distance (e.g., the distance between the adjacent vertical elongated fingers 105). The second predetermined distance may form an opening 325 in which the jewelry box user may slide the hoop earring 305 and organize the hoop earring 305 as shown in FIG. 3. In one or more aspects, a distance between the distal ends 315 of two adjacent horizontal elongated fingers may be same as a distance between the corresponding proximal ends 310. For example, as shown in FIG. 3, the plurality of horizontal elongated fingers 300 may be parallel to each other.

The vertical support structure 320 may be a cylindrical, hexagonal, rectangular or square shaped rod and may be made of plastic, wood or metal. In some aspects, the vertical support structure 320 may be made of same material as the plurality of horizontal elongated fingers 300. The distal ends 315 may be attached to the vertical support structure 320 by using a fastening means (not shown) or an adhesive.

In one or more aspects, the vertical support structure 320 may include a top end 330 and a bottom end 335. The vertical support structure 320 may be pivotably attached to a base 340 (same as the base 110) via the bottom end 335. Specifically, the vertical support structure 320 may be attached to the base 340 via a pivot means 345, which may be same as or similar to the pivot means 115. The pivot means 345 may enable the jewelry box user to move/rotate the plurality of horizontal elongated fingers 300 from an open position to a closed position. In some aspects, the pivot means 345 may allow automatic movement of the plurality of horizontal elongated fingers 300 (e.g., via a dedicated button or an actuator, as described in conjunction with FIG. 1). In some aspects, the plurality of horizontal elongated fingers 300 may be in the open position when the vertical support structure 320 is aligned vertically perpendicular to the base plane. Similarly, the plurality of horizontal elongated fingers 300 may be in the closed position when the vertical support structure 320 is aligned laterally parallel to the base plane.

In some aspects, a vertical tension member 350 may attach the distal end 315 of a horizontal elongated finger 300 to the distal end 315 of an adjacent horizontal elongated finger. The vertical tension member 350 (or a plurality of tension members 350) may be same as the plurality of horizontal tension members 140 and may be used to form an inward binding force between adjacent horizontal elongated fingers, which may vertically couple the adjacent horizontal elongated fingers.

In one or more aspects, the plurality of tension members 350 may be aligned parallel to a vertical support structure plane, as shown in FIG. 3. In other aspects, the plurality of tension members 350 may be slanted at an angle (e.g., in the range of 1 to 30 degrees) with respect to the vertical support structure plane.

The operation and functions of elements described in FIG. 3 for the plurality of horizontal elongated fingers 300 are same as the operation and functions of elements described in FIG. 1 for the plurality of vertical elongated fingers 105. Therefore, for the sake of simplicity, the operation and functions of elements shown in FIG. 3 are not described again here in detail.

In additional aspects, one or more horizontal elongated fingers of the horizontal elongated fingers 300 may be configured to rotate relative to each other. An example rotated horizontal elongated finger 355 is shown in FIG. 3. The rotated horizontal elongated finger 355 may assist the jewelry box user to organize multiple hoop earrings, especially large-sized hoop earrings, in the plurality of horizontal elongated fingers 300. In this case, the plurality of horizontal elongated fingers 300 may be pivotably connected with the vertical support structure 320 via another pivot means (not shown in FIG. 3). The other pivot means that connects the vertical support structure 320 with the plurality of horizontal elongated fingers 300 may be same as the pivot means 345 or may be different than the pivot means 345. In operation, the jewelry box user may rotate a horizontal elongated finger (e.g., the rotated horizontal elongated finger 355) relative to the remaining horizontal elongated fingers, when the jewelry box user wants to organize/insert a hoop earring (e.g., the hoop earring 305) in the rotated horizontal elongated finger 355. Further, the rotated horizontal elongated finger 355 may rotate back to its original position, when the jewelry box user inserts the hoop earring 305 in the rotated horizontal elongated finger 355.

In some aspects, each horizontal elongated finger may include one or more notches (not shown in FIG. 3) along a horizontal elongated finger length, which may enable the jewelry box user to securely place the hoop earring 305 in the notches.

In some aspects, a single jewelry box (e.g., the jewelry box 100) may include the plurality of vertical elongated fingers 105 and the plurality of horizontal elongated fingers 300, as described in conjunction with FIG. 4. Presence of both the plurality of vertical elongated fingers 105 and the plurality of horizontal elongated fingers 300 in a single jewelry box may enable the jewelry box user to organize multiple types of earrings in the jewelry box. For example, a person ordinarily skilled in the skilled may appreciate that the opening 135 (e.g., the distance between adjacent vertical elongated fingers) may allow stud earring storage, however the opening 135 may not be convenient to store the hoop earring 305 because of hoop earring structure. On the other hand, the opening 325 may allow hoop earring storage, however the opening 325 may not be convenient to store the stud earring 145. Therefore, presence of both the plurality of vertical elongated fingers 105 and the plurality of horizontal elongated fingers 300 in the jewelry box may enable the jewelry box user to organize, store and display the stud earring 145 and the hoop earring 305.

FIG. 4 depicts another example jewelry box 400 in accordance with the present disclosure. The jewelry box 400 may be rectangular or square shaped. Specifically, FIG. 4 depicts a top or an overhead view of a square-shaped jewelry box 400. The jewelry box 400 may include four sides of equal length, e.g., sides 405*a*, 405*b*, 405*c* and 405*d* (collectively referred to as sides 405). For example, each side may have a length of 4 inches, 6 inches or 12 inches.

In some aspects, the sides 405 may include vertical walls (not shown in FIG. 4) that may be perpendicular to a plane of a jewelry box base 410 (or a base 410). The vertical walls may act as boundary walls for the jewelry box 400. A height of the vertical walls included on each side may be same. For example, the vertical wall height may be two inches.

The jewelry box 400 may further include three sets 415*a*, 415*b* and 415*c* of a plurality of vertical elongated fingers. The plurality of vertical elongated fingers shown in FIG. 4 may be same as the plurality of vertical elongated fingers 105. The sets 415*a*, 415*b* and 415*c* may be pivotably attached to the base 410 at a predetermined distance from the respective sides 405*a*, 405*b* and 405*c*. The predetermined distance may be, for example, one inch, and the predetermined distance may form a gap 420 between each set and the corresponding side. In some aspects, the gap 420 may be coated with magnetic strips and may be configured to secure any stud earring that may fall from the three sets 415*a*, 415*b* and 415*c* (as described above).

In some aspects, each vertical elongated finger of the plurality of vertical elongated fingers may be of same length (or height as measured from the base 410) and width, and a number of vertical elongated fingers in each set 415*a*, 415*b* or 415*c* may depend on the length of the sides 405 and a width of the gap 420. Further, the number of vertical elongated fingers in each set 415*a*, 415*b* or 415*c* may depend on a width of an opening (e.g., the opening 135) that may be formed between adjacent vertical elongated fingers to hold stud earrings. For example, for a large jewelry box (e.g., with side dimension of 12 inches) with vertical elongated finger width of one inch and the opening width of 1/16 inches, the number of vertical elongated fingers in the sets 415*a*, 415*b* and 415*c* may be large. On the other hand, for a small jewelry box (e.g., with side dimension of four inches), the number of vertical elongated fingers in the sets 415*a*, 415*b* and 415*c* may be less.

In other aspects, the vertical elongated finger width and/or the opening width may be different in different sets 415*a*, 415*b* and 415*c*. In this case, the number of vertical elongated fingers in each set may be different from other sets.

In further aspects, the jewelry box 400 may include a set 415*d* of a plurality of horizontal elongated fingers arranged parallel to the side 405*d*. The plurality of horizontal elongated fingers shown in FIG. 4 may be same as the plurality of horizontal elongated fingers 300. As described above, the plurality of horizontal elongated fingers may be pivotably attached to the base 410 via a vertical support structure (not shown in FIG. 4).

In some aspects, a length of each horizontal elongated finger may be same as or equivalent to a distance between the sets 415*a* and 415*c*, when the sets 415*a* and 415*c* are in the open position. Further, a number of horizontal elongated fingers in the set 415*d* may depend on a width of each horizontal elongated finger, a distance between adjacent horizontal elongated fingers (which may form an opening, e.g., the opening 325) and a length of each vertical elongated finger. For example, the number of horizontal elongated fingers may be set in such a manner that a height of the set 415*d* (as measured from the base 410) may be same as the length of each vertical elongated finger. In this manner, the sets 415*a*, 415*b*, 415*c* and 415*d* may have same height, as measured from the base 410.

In operation, the jewelry box user may insert or slide a stud earring between any two adjacent vertical elongated fingers included in the sets 415*a*, 415*b* and 415*c*. Further, the jewelry box user may slide a hoop earring between any two adjacent horizontal elongated fingers (e.g., by rotating a horizontal elongated finger relative to other horizontal elongated fingers, as described in FIG. 3) included in the set 415*d*. In this manner, the jewelry box 400 may enable the jewelry box user to organize, store and display stud earrings and hoop earrings in the same jewelry box.

Furthermore, the jewelry box user may pivotably rotate/move the sets 415*a*, 415*b*, 415*c* and 415*d* from the open position to the closed position (or rest position), when the jewelry box 400 is not in use. As described above, the jewelry box open position may be an arrangement in which the sets 415*a*, 415*b*, 415*c* and 415*d* are aligned vertically perpendicular to the base plane and the jewelry box closed position may be an arrangement in which the sets 415*a*, 415*b*, 415*c* and 415*d* are aligned laterally parallel to the base plane. In some aspects, the jewelry box user may rotate/move each set one-by-one and rest each set on an open base area formed between the four sets (e.g., the sets 415*a*, 415*b*, 415*c* and 415*d*). For instance, the jewelry box user may first move the set 415*a* and lay it on the open base area, then move the set 415*b*, 415*c* and may move the set 415*d* at the last. In other aspects, the operation mentioned above may be performed automatically by the use of a dedicated button or an actuator, as described above. For example, the dedicated button may be placed anywhere on the base 410 and pressing the dedicated button may cause the sets 415*a*, 415*b*, 415*c* and 415*d* to move from the open position to the closed position automatically, one-by-one.

In some aspects, a jewelry box cover may be formed by the last set that may be moved and laid over the remaining sets. For example, in the instance described above, the set 415*d* may form the jewelry box cover. In this manner, the jewelry box 400 may not require a dedicated and separate cover. Further, the jewelry box user may easily carry the jewelry box 400 by moving or folding the sets described herein, when the jewelry box 400 is not in use. Therefore, the jewelry box 400, as described in the present disclosure, is portable and is convenient for the jewelry box user to carry.

Although FIG. 4 is shown to include one set of horizontal elongated fingers and three sets of vertical elongated fingers, a person ordinarily skilled in the art may appreciate that the jewelry box 400 may include two or three sets of horizontal elongated fingers and one or two sets of vertical elongated fingers, without departing from the present disclosure scope.

FIG. 5 depicts yet another example jewelry box 500 in accordance with the present disclosure. Specifically, FIG. 5 depicts a top or an overhead view of the jewelry box 500. The jewelry box 500 may include a set of a plurality of vertical elongated fingers 505 (same as the plurality of vertical elongated fingers 105) that may be attached to a base 510 (same as the base 110) in a circular arrangement. In an exemplary embodiment, each vertical elongated finger may have a thickness of 1/16 inches, a width of half-an-inch and a length (or height as measure from the base 510) in a range of three to eight inches.

As described above, a horizontal tension member (not shown in FIG. 5) may attach distal ends of each vertical elongated finger with the distal ends of adjacent vertical elongated fingers to form a binding force between adjacent vertical elongated fingers. The binding force and an opening 515 (same as the opening 135) may enable the jewelry box user to store and display stud earrings in the jewelry box 500.

The jewelry box 500 may include an outer circumference 520 that may include a vertical wall (not shown) of a predetermined height. The vertical wall may act as jewelry box boundary. As an example, the outer circumference 520 may have a diameter in a range of 8 to 12 inches. Further, the vertical wall height may be, for example, one inch. Further, the jewelry box 500 may include a gap 525 that be formed between the outer circumference 520 and the circular plurality of vertical elongated fingers 505. The gap 525 may have a width of one inch and may be coated with a magnetic strip. The gap 525 may be configured to secure any stud earring that may fall off from the plurality of vertical elongated fingers 505, as described above.

In other aspects, an entire base area or a substantial base area may include magnetic strip, as opposed to only the gap 525 having the magnetic strip.

A base open area, formed between the plurality of vertical elongated fingers 505, may enable the jewelry box user to easily secure or remove a stud earring from the opening 515. Further, in some aspects, the jewelry box 500 may be configured to rotate around a base center 530. Specifically, the jewelry box 500 may be used to organize and display stud earring collection and may be used in a jewelry showroom (or home). The jewelry box 500 may be rotated around a base center axis, which may enable a user to easily view an entire collection of stud earring that may be stored in the jewelry box 500. Furthermore, the jewelry box 500 may include one or more handles 535, using which the user may rotate the jewelry box 500 about the base center axis.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc., should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A jewelry box comprising:

a base;

a plurality of vertical elongated fingers pivotably attached to the base, wherein each vertical elongated finger comprises a flattened front surface and a flattened back surface, and wherein:

the plurality of vertical elongated fingers is placed adjacent to each other and at a first predetermined distance from each other, wherein the first predetermined distance between a pair of vertical elongated fingers forms a first opening configured to hold a first jewelry item, and wherein flattened front surfaces of adjacent vertical elongated fingers touch a first jewelry item front portion, and flattened back surfaces of the adjacent vertical elongated fingers touch a first jewelry item back portion to hold the first jewelry item in the first opening, the plurality of vertical elongated fingers comprises vertical finger proximal ends and vertical finger distal ends, the plurality of vertical elongated fingers is attached to the base via the vertical finger distal ends, and the plurality of vertical elongated fingers is configured to pivot around the vertical finger distal ends to move the plurality of vertical elongated fingers between an open position and a closed position, and wherein the plurality of vertical elongated fingers is in the open position when the plurality of vertical elongated fingers is perpendicular to a base plane and in the closed position when the plurality of vertical elongated fingers is parallel to the base plane; and a plurality of horizontal tension members attached in proximity to the vertical finger distal ends, wherein each horizontal tension member is configured to horizontally couple the pair of vertical elongated fingers.

2. The jewelry box of claim 1, wherein each horizontal tension member comprises a spring to couple the pair of vertical elongated fingers.

3. The jewelry box of claim 1, wherein the first jewelry item is a stud earring.

4. The jewelry box of claim 1, wherein each of the flattened front surface and the flattened back surface comprises a magnetic material.

5. The jewelry box of claim 1, wherein each vertical elongated finger is of same length and width.

6. The jewelry box of claim 1, wherein each proximal end is semi-circular in shape.

7. The jewelry box of claim 1, wherein a distance between proximal ends of the pair of vertical elongated fingers is greater than a distance between distal ends of the pair of vertical elongated fingers such that the first opening between the adjacent vertical elongated fingers is a V-shaped opening.

8. The jewelry box of claim 1, wherein the plurality of vertical elongated fingers is attached to the base in a linear arrangement.

9. The jewelry box of claim 1, wherein the plurality of vertical elongated fingers is attached to the base in a circular arrangement.

10. The jewelry box of claim 1, wherein the plurality of vertical elongated fingers is attached to the base in a square arrangement.

11. The jewelry box of claim 1, wherein the base comprises a plurality of magnetic strips.

12. The jewelry box of claim 1 further comprising:

a plurality of horizontal elongated fingers attached to a vertical support structure, wherein:

the plurality of horizontal elongated fingers is placed adjacent to each other along a vertical support structure length and at a second predetermined distance from each other, the plurality of horizontal elongated fingers comprises horizontal finger proximal ends and horizontal finger distal ends, the plurality of horizontal elongated fingers is attached to the vertical support structure via the horizontal finger distal ends, and the vertical support structure is pivotably attached to the base; and a plurality of vertical tension members attached in proximity to the horizontal finger distal ends, wherein each vertical tension member is configured to vertically couple a pair of horizontal elongated fingers.

13. The jewelry box of claim 12, wherein the second predetermined distance between the pair of horizontal elongated fingers forms a second opening configured to hold a second jewelry item.

14. The jewelry box of claim 13, wherein the second jewelry item is a hoop earring.

15. A jewelry box comprising:

a base comprising a plurality of magnetic strips;

a plurality of vertical elongated fingers pivotably attached to the base, wherein each vertical elongated finger comprises a flattened front surface and a flattened back surface, and wherein:

the plurality of vertical elongated fingers is placed adjacent to each other and at a first predetermined distance from each other, wherein the first predetermined distance between a pair of vertical elongated fingers forms a first opening configured to hold a first jewelry item, and wherein flattened front surfaces of adjacent vertical elongated fingers touch a first jewelry item front portion, and flattened back surfaces of the adjacent vertical elongated fingers touch a first jewelry item back portion to hold the first jewelry item in the first opening, the plurality of vertical elongated fingers comprises vertical finger proximal ends and vertical finger distal ends, the plurality of vertical elongated fingers is attached to the base via the vertical finger distal ends, and the plurality of vertical elongated fingers is configured to pivot around the vertical finger distal ends to move the plurality of vertical elongated fingers between an open position and a closed position, and wherein the plurality of vertical elongated fingers is in the open position when the plurality of vertical elongated fingers is perpendicular to a base plane and in the closed position when the plurality of vertical elongated fingers is parallel to the base plane; and a plurality of horizontal tension members attached in proximity to the vertical finger distal ends, wherein each horizontal tension member is configured to horizontally couple the pair of vertical elongated fingers.

16. The jewelry box of claim 15 further comprising:

a plurality of horizontal elongated fingers attached to a vertical support structure, wherein:

the plurality of horizontal elongated fingers is placed adjacent to each other along a vertical support structure length and at a second predetermined distance from each other, the plurality of horizontal elongated fingers comprises horizontal finger proximal ends and horizontal finger distal ends, the plurality of horizontal elongated fingers is attached to the vertical support structure via the horizontal finger distal ends, and the vertical support structure is pivotably attached to the base; and a plurality of vertical tension members attached in proximity the horizontal finger distal ends, wherein each vertical tension member is configured to vertically couple a pair of horizontal elongated fingers.

17. The jewelry box of claim 16, wherein the second predetermined distance between the pair of horizontal elongated fingers forms a second opening configured to hold a second jewelry item.

18. A jewelry box comprising:

a base;

a plurality of vertical elongated fingers pivotably attached to the base, wherein each vertical elongated finger comprises a flattened front surface and a flattened back surface, and wherein:

the plurality of vertical elongated fingers is placed adjacent to each other and at a first predetermined distance from each other, wherein the first predetermined distance between a pair of vertical elongated fingers forms a first opening configured to hold a first jewelry item, and wherein flattened front surfaces of adjacent vertical elongated fingers touch a first jewelry item front portion, and flattened back surfaces of the adjacent vertical elongated fingers touch a first jewelry item back portion to hold the first jewelry item in the first opening, the plurality of vertical elongated fingers comprises vertical finger proximal ends and vertical finger distal ends, the plurality of vertical elongated fingers is attached to the base via the vertical finger distal ends, and the plurality of vertical elongated fingers is configured to pivot around the vertical finger distal ends to move the plurality of vertical elongated fingers between an open position and a closed position, and wherein the plurality of vertical elongated fingers is in the open position when the plurality of vertical elongated fingers is perpendicular to a base plane and in the closed position when the plurality of vertical elongated fingers is parallel to the base plane;

a plurality of horizontal tension members attached in proximity to the vertical finger distal ends, wherein each horizontal tension member is configured to horizontally couple a pair of vertical elongated fingers;

a plurality of horizontal elongated fingers attached to a vertical support structure, wherein:

the plurality of horizontal elongated fingers is placed adjacent to each other along a vertical support structure length and at a second predetermined distance from each other, the plurality of horizontal elongated fingers comprises horizontal finger proximal ends and horizontal finger distal ends, the plurality of horizontal elongated fingers is attached to the vertical support structure via the horizontal finger distal ends, and the vertical support structure is pivotably attached to the base; and a plurality of vertical tension members attached in proximity to the horizontal finger distal ends, wherein each vertical tension member is configured to vertically couple a pair of horizontal elongated fingers.

19. The jewelry box of claim 1, wherein at least one horizontal tension member of the plurality of horizontal tension members is disposed on the flattened front surface.

20. The jewelry box of claim 15, wherein at least one horizontal tension member of the plurality of horizontal tension members is disposed on the flattened front surface.

* * * * *